US011211014B2

(12) United States Patent
Han et al.

(10) Patent No.: US 11,211,014 B2
(45) Date of Patent: Dec. 28, 2021

(54) PIXEL CIRCUIT, DISPLAY PANEL AND DISPLAY DEVICE

(71) Applicant: SHENZHEN CHINA STAR OPTOELECTRONICS SEMICONDUCTOR DISPLAY TECHNOLOGY CO., LTD., Shenzhen (CN)

(72) Inventors: Zhibin Han, Shenzhen (CN); Baixiang Han, Shenzhen (CN)

( * ) Notice: Subject to any disclaimer, the term of this patent is extended or adjusted under 35 U.S.C. 154(b) by 192 days.

(21) Appl. No.: 16/617,509

(22) PCT Filed: Sep. 12, 2019

(86) PCT No.: PCT/CN2019/105527

§ 371 (c)(1),
(2) Date: Nov. 27, 2019

(87) PCT Pub. No.: WO2021/035810

PCT Pub. Date: Mar. 4, 2021

(65) Prior Publication Data

US 2021/0335274 A1 Oct. 28, 2021

(30) Foreign Application Priority Data

Aug. 28, 2019 (CN) ..... 201910799618.1

(51) Int. Cl.
*G09G 3/3275* (2016.01)

(52) U.S. Cl.
CPC ... *G09G 3/3275* (2013.01); *G09G 2300/0819* (2013.01); *G09G 2300/0847* (2013.01); *G09G 2320/0233* (2013.01)

(58) Field of Classification Search
CPC ..... G09G 3/3275; G09G 2300/0819; G09G 2300/0847; G09G 2320/0233
See application file for complete search history.

(56) References Cited

U.S. PATENT DOCUMENTS

2009/0225011 A1* 9/2009 Choi ..... G09G 3/3233 345/77
2009/0225012 A1* 9/2009 Choi ..... G09G 3/3233 345/80

(Continued)

FOREIGN PATENT DOCUMENTS

CN 101533851 A 9/2009
CN 103927975 A 7/2014

(Continued)

*Primary Examiner* — Ibrahim A Khan

(57) ABSTRACT

A display panel, a display panel and a pixel circuit are proposed. The pixel circuit includes a first TFT, a second TFT, a first capacitor, a second capacitor, and a lighting device. The feedback compensation signal and the first control signal have a same phase but different directions. The second TFT includes a gate receiving a first control signal, a source receiving a data signal, and a drain electrically connected to the first node. The second capacitor includes a first end electrically receiving a feedback compensation signal and a second end electrically connected the first node. The feedback compensation signal has the same phase but different direction of the first control signal. This could realize the self-compensation mechanism of the pixel circuit and thus solve the non-uniformity issue of the conventional display panel and display device.

15 Claims, 3 Drawing Sheets

(56) References Cited

U.S. PATENT DOCUMENTS

| | | | | |
|---|---|---|---|---|
| 2011/0156611 | A1 | 6/2011 | Tsai | |
| 2013/0120228 | A1* | 5/2013 | Yoon | G09G 3/3291 345/80 |
| 2014/0354285 | A1* | 12/2014 | Kim | G09G 3/3233 324/414 |
| 2015/0187266 | A1 | 7/2015 | Qian et al. | |
| 2016/0086546 | A1* | 3/2016 | Noh | G09G 3/3258 345/80 |
| 2016/0155387 | A1* | 6/2016 | Kim | G09G 3/3291 345/76 |
| 2017/0039941 | A1 | 2/2017 | Wu et al. | |
| 2017/0294163 | A1 | 10/2017 | Wu et al. | |
| 2018/0061293 | A1* | 3/2018 | Park | G09G 3/006 |
| 2018/0240400 | A1 | 8/2018 | Zhou et al. | |

FOREIGN PATENT DOCUMENTS

| | | | |
|---|---|---|---|
| CN | 104680982 | A | 6/2015 |
| CN | 107680537 | A | 2/2018 |
| CN | 108564922 | A | 9/2018 |
| CN | 109785800 | A | 5/2019 |
| CN | 110070833 | A | 7/2019 |
| CN | 110164378 | A | 8/2019 |
| JP | 2009288590 | A | 12/2009 |

* cited by examiner

PIXEL CIRCUIT, DISPLAY PANEL AND DISPLAY DEVICE

FIELD OF THE INVENTION

The present invention relates to the display field, and more particularly to a pixel circuit, a display panel and a display device.

BACKGROUND

As the progress of the display technology, the demands of the display panel are higher. The display uniformity of the display panel is an important indication of the quality of the display panel. This means that a high quality display panel should have a very good display uniformity. In a conventional display panel, the pixel driving circuit is often implemented with a 2T1C structure, namely a structure of two thin film transistors (TFT) and one capacitor, to transform a voltage to a current.

Because the driving TFT of the pixel circuit has a parasitic capacitor, when the gate of the driving TFT is turned off, the parasitic capacitor pulls down the gate such that the charges of the gate flow to the parasitic capacitor. This makes the voltage of the driving TFT be different from the voltage being written into the driving TFT. Further, the gate line has its transverse capacitor and transverse resistor, which introduce signal delays. Different signal delay causes the clock feedthrough effect. Therefore, the display panel may have transverse display difference. It ruins the display uniformity of the display panel.

Please refer to FIG. 1. FIG. 1 is a diagram showing gate voltages of driving TFTs at different positions of a conventional display panel. The curve L1 represents the gate voltages of the left lower part A of the pixel circuit 110 shown in FIG. 2. The curve L2 represents the gate voltages of the right lower part B of the pixel circuit 110 shown in FIG. 2. As shown in the dotted circuit of FIG. 1, the voltage drop-down degrees of the part A and the part B are different due to the above-mentioned feedthrough effect.

From the above, a pixel circuit, a display panel and a display device are required to solve the above-mentioned non-uniformity issue caused by the feedthrough effect.

SUMMARY

One objective of an embodiment of the present invention is to provide a pixel circuit, a display panel and a display device to solve the above-mentioned non-uniformity issue.

According to an embodiment of the present invention, a pixel circuit is provided. The pixel circuit comprises: a first thin film transistor (TFT), a second TFT, a first capacitor electrically connected between the first node and the second node, a second capacitor, and a lighting device. The feedback compensation signal and the first control signal have a same phase but different directions. The first TFT includes a gate electrically connected to a first node, a source receiving a working voltage, and a drain electrically connected to a second node. The second TFT includes a gate receiving a first control signal, a source receiving a data signal, and a drain electrically connected to the first node. The second capacitor includes a first end electrically receiving a feedback compensation signal and a second end electrically connected the first node.

Optionally, the first control signal corresponds to a high voltage level and the feedback compensation signal corresponds to a low voltage level in a data writing phase, and the first control signal corresponds to a low voltage level and the feedback compensation signal corresponds to a high voltage level in a lighting phase.

Optionally, a parasitic capacitance Cgs of the second TFT, a voltage value V1 of the first control signal, a voltage value V2 of the feedback compensation signal and a capacitance C2 of the second capacitor complies with an equation Cgs*V1=V2*C2.

Optionally, a range of the voltage value V1 of the first control signal is from −6V to 24V.

Optionally, the lighting device is an organic light emitting diode (OLED). An anode of the lighting device is electrically connected to the second node and a cathode of the lighting device is electrically connected to a common ground voltage.

Optionally, the pixel structure further includes a third TFT which includes a gate receiving a second control signal, a source receiving a test compensation signal and a drain electrically connected to the second node.

According to an embodiment of the present invention, a display panel is provided. The display panel comprises a pixel circuit. The pixel circuit includes a first thin film transistor (TFT), a second TFT, a first capacitor electrically connected between the first node and the second node, a second capacitor, and a lighting device. The feedback compensation signal and the first control signal have a same phase but different directions. The first TFT includes a gate electrically connected to a first node, a source receiving a working voltage, and a drain electrically connected to a second node. The second TFT includes a gate receiving a first control signal, a source receiving a data signal, and a drain electrically connected to the first node. The second capacitor includes a first end electrically receiving a feedback compensation signal and a second end electrically connected the first node.

Optionally, the first control signal corresponds to a high voltage level and the feedback compensation signal corresponds to a low voltage level in a data writing phase, and the first control signal corresponds to a low voltage level and the feedback compensation signal corresponds to a high voltage level in a lighting phase.

Optionally, a parasitic capacitance Cgs of the second TFT, a voltage value V1 of the first control signal, a voltage value V2 of the feedback compensation signal and a capacitance C2 of the second capacitor complies with an equation Cgs*V1=V2*C2.

Optionally, a range of the voltage value V1 of the first control signal is from −6V to 24V.

Optionally, the lighting device is an organic light emitting diode (OLED). An anode of the lighting device is electrically connected to the second node and a cathode of the lighting device is electrically connected to a common ground voltage.

Optionally, the pixel structure further includes a third TFT which includes a gate receiving a second control signal, a source receiving a test compensation signal and a drain electrically connected to the second node.

According to an embodiment of the present invention, a display panel is provided. The display device comprises a display panel comprising a pixel circuit. The pixel circuit includes a first thin film transistor (TFT), a second TFT, a first capacitor electrically connected between the first node and the second node, a second capacitor, and a lighting device. The feedback compensation signal and the first control signal have a same phase but different directions. The first TFT includes a gate electrically connected to a first node, a source receiving a working voltage, and a drain electrically connected to a second node. The second TFT includes a gate receiving a first control signal, a source receiving a data signal, and a drain electrically connected to the first node. The second capacitor includes a first end electrically receiving a feedback compensation signal and a second end electrically connected the first node.

Optionally, the first control signal corresponds to a high voltage level and the feedback compensation signal corresponds to a low voltage level in a data writing phase, and the first control signal corresponds to a low voltage level and the feedback compensation signal corresponds to a high voltage level in a lighting phase.

Optionally, a parasitic capacitance Cgs of the second TFT, a voltage value V1 of the first control signal, a voltage value V2 of the feedback compensation signal and a capacitance C2 of the second capacitor complies with an equation Cgs*V1=V2*C2.

Optionally, a range of the voltage value V1 of the first control signal is from −6V to 24V.

Optionally, the lighting device is an organic light emitting diode (OLED). An anode of the lighting device is electrically connected to the second node and a cathode of the lighting device is electrically connected to a common ground voltage.

Optionally, the pixel structure further includes a third TFT which includes a gate receiving a second control signal, a source receiving a test compensation signal and a drain electrically connected to the second node.

In an embodiment of the present invention, the gate of the first TFT is connected to the second capacitor and the second end of the second capacitor is connected to a feedback compensation signal having the same phase but different direction of the first control signal. This could compensate, through the second capacitor, the voltage drop caused by the parasitic capacitor of the second TFT to prevent the gate voltage of the first TFT from changing. Because the voltage of the feedback compensation signal may have its RC delay caused by the transverse line, this RC delay of the feedback compensation signal could compensate the RC delay of the first control signal. This could realize the self-compensation mechanism of the pixel circuit and thus solve the non-uniformity issue of the conventional display panel and display device.

BRIEF DESCRIPTION OF THE DRAWINGS

To describe the technical solutions in the embodiments of this application more clearly, the following briefly introduces the accompanying drawings required for describing the embodiments. Apparently, the accompanying drawings in the following description show merely some embodiments of this application, and a person of ordinary skill in the art may still derive other drawings from these accompanying drawings without creative efforts.

DETAILED DESCRIPTION OF PREFERRED EMBODIMENTS

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

Specifically, the terminologies in the embodiments of the present invention are merely for describing the purpose of the certain embodiment, but not to limit the invention.

Embodiment 1

Figure 1:
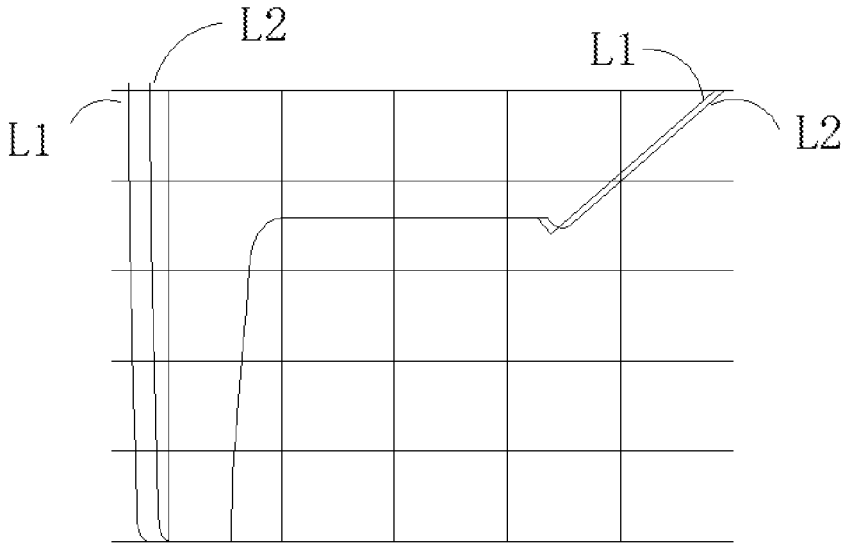
Fig. 1 (Related art)
FIG. 1 is a diagram showing gate voltages of driving TFTs at different positions of a conventional display panel.
Figure 2:
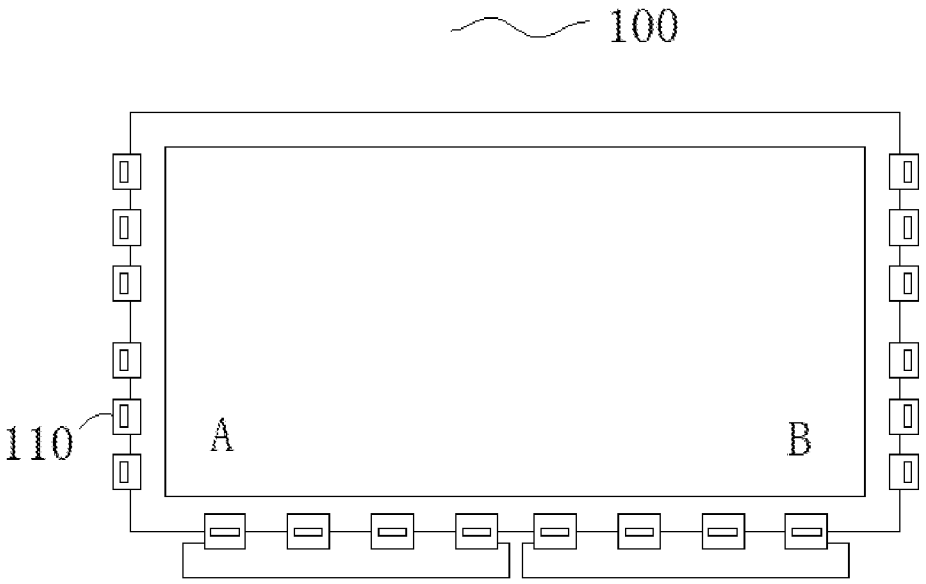
FIG. 2 is a diagram of a pixel circuit of a display panel.
Figure 3:
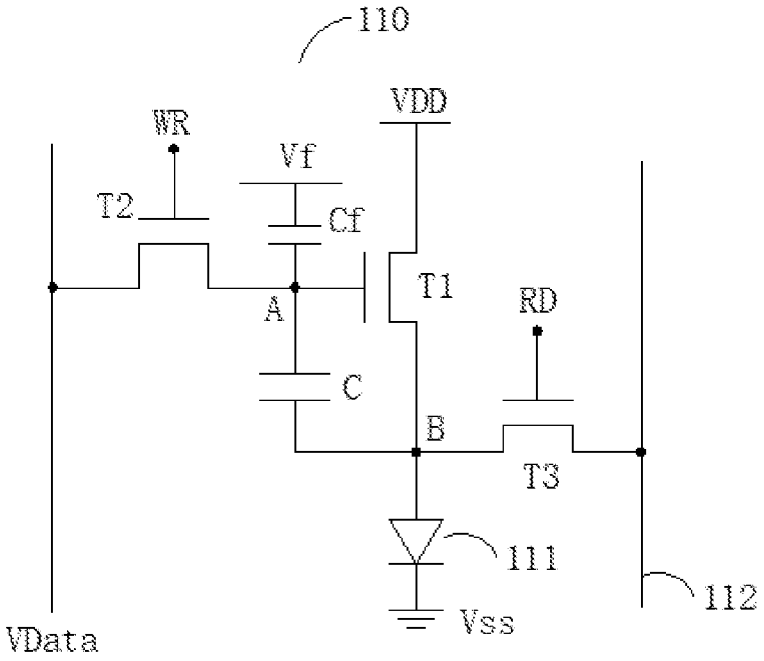
FIG. 3 is a circuit diagram of a pixel circuit according to an embodiment of the present invention.

In this embodiment, a pixel structure is provided. Please refer to FIGS. 2, 3, and 4. As shown in FIG. 3, FIG. 3 is a circuit diagram of a pixel circuit according to an embodiment of the present invention. The pixel circuit comprises a first TFT T1, a second TFT T2, a first capacitor C, a second capacitor Cf, and a lighting unit 111.

The gate of the first TFT T1 is electrically connected to the first node A. The source of the first TFT T1 receives the working voltage VDD. The drain of the first TFT T1 is electrically connected to the second node B. The gate of the second TFT T2 receives a first control signal WR. The source of the second TFT T2 is receives the data voltage VData. The drain of the second TFT T2 is electrically connected to the first node A. The first end of the first capacitor C is electrically connected to the first node A. The second end of the first capacitor C is electrically connected to the second node B. The first end of the second capacitor Cf electrically receives the feedback compensation signal Vf. The second end of the second capacitor Cf is electrically connected to the first node A.

Figure 4:
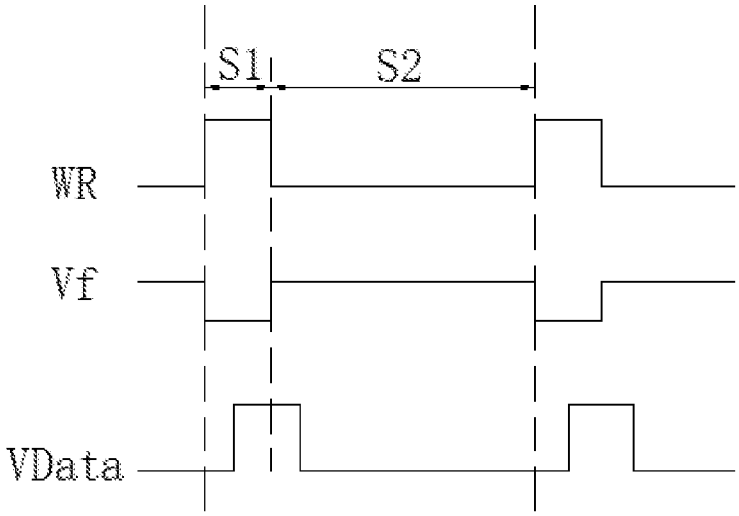
FIG. 4 is a diagram of timing sequences of a pixel circuit according to an embodiment of the present invention.

The feedback compensation signal Vf and the first control signal WR have the same phase but different directions. As shown in FIG. 4, FIG. 4 is a diagram of timing sequences of a pixel circuit according to an embodiment of the present invention. The pixel circuit comprises a data writing phase S1 and a lighting phase S2. The data writing phase S1 and the lighting phase S2 constitute a frame.

In the data writing phase S1, the first control signal WR corresponds to a high voltage level and the feedback compensation signal Vf corresponds to a low voltage level. The second TFT T2 is conductive. The data signal VData corresponds to a high voltage level. The data signal VData enters the gate of the first TFT T1 through the conductive second TFT T2. At this time, the gate voltage of the first TFT T1 is equal to the voltage of the data signal VData. Further, the feedback compensation signal Vf corresponds to a low voltage level.

In the lighting phase S2, the first control signal WR and the data signal VData are both switched to a low voltage level, the second TFT T2 is cut off, and the first TFT T1 is conductive. At the time, the feedback compensation signal Vf is switched to a high voltage level such that the voltage of the feedback compensation signal Vf is higher than the voltage of the first control signal. That is, the voltage of the feedback compensation signal Vf is also higher than the gate voltage of the first TFT T1 such that the voltage drop caused by the parasitic capacitor of the first TFT T1 is compensated. This makes the gate voltage of the first TFT T1 remain unchanged.

In this embodiment, the voltage V2 of the feedback compensation signal and the capacitance C2 of the second capacitor could be determined according the capacitance Cgs of the parasitic capacitor of the second TFT T2 and the voltage V1 of the first control signal WR by the following equation: Cgs*V1=V2*C2.

In another embodiment, they could be calculated according to the real conditions of the feedback compensation signal Vf and the second capacitor Cf.

The range of the voltage V1 of the first controls signal is from −6V to 24V. The capacitance of the parasitic capacitor is often around 15 Ff. The capacitance of the second capacitor Cf is often around 30 Ff. Then, the voltage of the feedback compensation signal could be from −8V to 2V.

The lighting unit 111 is an OLED. The anode of the lighting unit 111 is electrically connected to the second node B. The cathode of the lighting unit 111 is connected to a common ground voltage VSS. In another embodiment, the lighting unit 111 could be an inorganic LED.

The pixel circuit further comprises a third TFT T3. The gate of the third TFT T3 receives a second control signal RD. The source of the third TFT T3 receives a test compensation signal 112. The drain of the third TFT T3 is electrically connected to the second node B. The test compensation signal 112 could be used to compensate the threshold voltage of the first TFT T1 by testing the threshold voltage of the first TFT T1 such that the uniformity of the luminance of the lighting unit 11 could be ensured.

Embodiment 2

In this embodiment, a display panel is provided. Please refer to FIGS. 2, 3, 4, and 5. FIG. 2 is a diagram of a pixel circuit of a display panel 100. FIG. 3 is a circuit diagram of a pixel circuit according to an embodiment of the present invention. The display panel 100 comprises at least one pixel circuit 110. The pixel circuit comprises a first TFT T1, a second TFT T2, a first capacitor C, a second capacitor Cf, and a lighting unit 111.

The gate of the first TFT T1 is electrically connected to the first node A. The source of the first TFT T1 receives the working voltage VDD. The drain of the first TFT T1 is electrically connected to the second node B. The gate of the second TFT T2 receives a first control signal WR. The source of the second TFT T2 is receives the data voltage VData. The drain of the second TFT T2 is electrically connected to the first node A. The first end of the first capacitor C is electrically connected to the first node A. The second end of the first capacitor C is electrically connected to the second node B. The first end of the second capacitor Cf electrically receives the feedback compensation signal Vf. The second end of the second capacitor Cf is electrically connected to the first node A.

The feedback compensation signal Vf and the first control signal WR have the same phase but different directions. As shown in FIG. 4, FIG. 4 is a diagram of timing sequences of a pixel circuit according to an embodiment of the present invention. The pixel circuit comprises a data writing phase S1 and a lighting phase S2. The data writing phase S1 and the lighting phase S2 constitute a frame.

In the data writing phase S1, the first control signal WR corresponds to a high voltage level and the feedback compensation signal Vf corresponds to a low voltage level. The second TFT T2 is conductive. The data signal VData corresponds to a high voltage level. The data signal VData enters the gate of the first TFT T1 through the conductive second TFT T2. At this time, the gate voltage of the first TFT T1 is equal to the voltage of the data signal VData. Further, the feedback compensation signal Vf corresponds to a low voltage level.

In the lighting phase S2, the first control signal WR and the data signal VData are both switched to a low voltage level, the second TFT T2 is cut off, and the first TFT T1 is conductive. At the time, the feedback compensation signal Vf is switched to a high voltage level such that the voltage of the feedback compensation signal Vf is higher than the voltage of the first control signal. That is, the voltage of the feedback compensation signal Vf is also higher than the gate voltage of the first TFT T1 such that the voltage drop caused by the parasitic capacitor of the first TFT T1 is compensated. This makes the gate voltage of the first TFT T1 remain unchanged.

In this embodiment, the voltage V2 of the feedback compensation signal and the capacitance C2 of the second capacitor could be determined according the capacitance Cgs of the parasitic capacitor of the second TFT T2 and the voltage V1 of the first control signal WR by the following equation: Cgs*V1=V2*C2.

In another embodiment, they could be calculated according to the real conditions of the feedback compensation signal Vf and the second capacitor Cf.

The range of the voltage V1 of the first controls signal is from −6V to 24V. The capacitance of the parasitic capacitor is often around 15 Ff. The capacitance of the second capacitor Cf is often around 30 Ff. Then, the voltage of the feedback compensation signal could be from −8V to 2V.

The lighting unit 111 is an OLED. The anode of the lighting unit 111 is electrically connected to the second node B. The cathode of the lighting unit 111 is connected to a common ground voltage VSS. In another embodiment, the lighting unit 111 could be an inorganic LED.

The pixel circuit further comprises a third TFT T3. The gate of the third TFT T3 receives a second control signal RD. The source of the third TFT T3 receives a test compensation signal 112. The drain of the third TFT T3 is electrically connected to the second node B. The test compensation signal 112 could be used to compensate the threshold voltage of the first TFT T1 by testing the threshold voltage of the first TFT T1 such that the uniformity of the luminance of the lighting unit 11 could be ensured.

Figure 5:
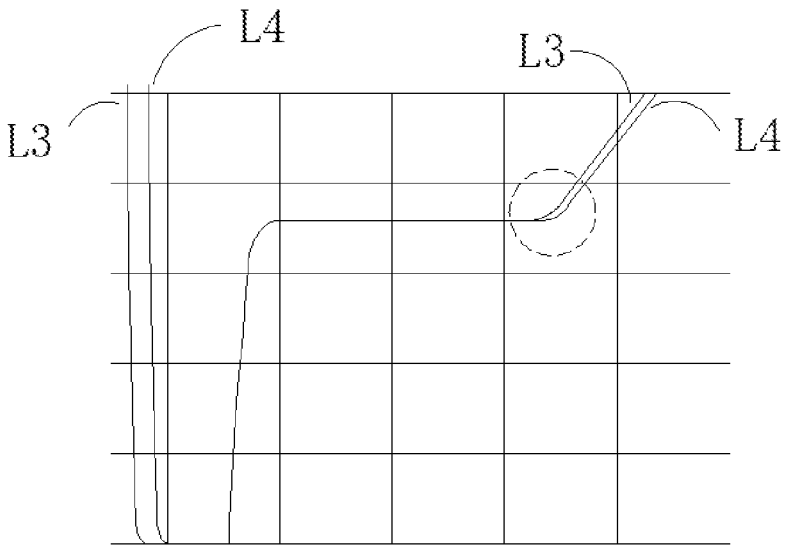
FIG. 5 is a diagram showing gate voltages of driving TFTs at different positions of a display panel according to an embodiment of the present invention.

Please refer to FIG. 5. FIG. 5 is a diagram showing gate voltages of driving TFTs at different positions of a display panel according to an embodiment of the present invention. In FIG. 5, the curve L3 represents the gate voltages of the left lower part A of the pixel circuit 110 shown in FIG. 2. The curve L4 represents the gate voltages of the right lower part B of the pixel circuit 110 shown in FIG. 2. From FIG. 5, it could be see that the above-mentioned pixel circuit and the display panel could make the voltage of the first TFT T1 remain stable and rising when the data writing phase S1 is switched to the lighting phase S2. No voltage drop is observed.

In an embodiment of the present invention, the gate of the first TFT T1 is connected to the second capacitor Cf and the second end of the second capacitor Cf is connected to a feedback compensation signal Vf having the same phase but different direction of the first control signal. This could compensate, through the second capacitor Cf, the voltage drop caused by the parasitic capacitor of the second TFT T2 to prevent the gate voltage of the first TFT T1 from changing. Because the voltage of the feedback compensation signal Vf may have its RC delay caused by the transverse line, this RC delay of the feedback compensation signal Vf could compensate the RC delay of the first control signal WR. This could realize the self-compensation mechanism of the pixel circuit 110 and thus solve the non-uniformity issue of the conventional display panel and display device.

Further, in an embodiment, a display device is provided. The display device comprises the above-mentioned display panel. The display panel comprises the above-mentioned pixel circuit and thus could have the above-mentioned characteristic. Further illustrations are omitted here.

Above are embodiments of the present invention, which does not limit the scope of the present invention. Any modifications, equivalent replacements or improvements within the spirit and principles of the embodiment described above should be covered by the protected scope of the invention.

What is claimed is:

1. A pixel circuit, comprising:

a first thin film transistor (TFT), having a gate electrically connected to a first node, a source receiving a working voltage and a drain electrically connected to a second node;

a second TFT, having a gate receiving a first control signal, a source receiving a data signal, a drain electrically connected to the first node;

a first capacitor, having a first end electrically connected to the first node and a second end electrically connected to the second node;

a second capacitor, having a first end electrically receiving a feedback compensation signal and a second end electrically connected the first node; and a lighting device;

wherein the feedback compensation signal and the first control signal have a same phase but different directions, and wherein a parasitic capacitance Cgs of the second TFT, a voltage value V1 of the first control signal, a voltage value V2 of the feedback compensation signal, and a capacitance C2 of the second capacitor complies with an equation Cgs*V1=V2*C2.

2. The pixel circuit of claim 1, wherein the first control signal corresponds to a high voltage level and the feedback compensation signal corresponds to a low voltage level in a data writing phase, and the first control signal corresponds to a low voltage level and the feedback compensation signal corresponds to a high voltage level in a lighting phase.

3. The pixel circuit of claim 1, wherein a range of the voltage value V1 of the first control signal is from −6V to 24V.

4. The pixel circuit of claim 1, wherein the lighting device is an organic light emitting diode (OLED), an anode of the lighting device is electrically connected to the second node and a cathode of the lighting device is electrically connected to a common ground voltage.

5. The pixel structure of claim 4, further comprising:

a third TFT, having a gate receiving a second control signal, a source receiving a test compensation signal and a drain electrically connected to the second node.

6. A display panel comprising a pixel circuit, the pixel circuit comprising:

a first thin film transistor (TFT), having a gate electrically connected to a first node, a source receiving a working voltage and a drain electrically connected to a second node;

a second TFT, having a gate receiving a first control signal, a source receiving a data signal, a drain electrically connected to the first node;

a first capacitor, having a first end electrically connected to the first node and a second end electrically connected to the second node;

a second capacitor, having a first end electrically receiving a feedback compensation signal and a second end electrically connected the first node; and a lighting device;

wherein the feedback compensation signal and the first control signal have a same phase but different directions, and wherein a parasitic capacitance Cgs of the second TFT, a voltage value V1 of the first control signal, a voltage value V2 of the feedback compensation signal and a capacitance C2 of the second capacitor complies with an equation Cgs*V1=V2*C2.

7. The display panel of claim 6, wherein the first control signal corresponds to a high voltage level and the feedback compensation signal corresponds to a low voltage level in a data writing phase, and the first control signal corresponds to a low voltage level and the feedback compensation signal corresponds to a high voltage level in a lighting phase.

8. The display panel of claim 6, wherein a range of the voltage value V1 of the first control signal is from −6V to 24V.

9. The display panel of claim 6, wherein the lighting device is an organic light emitting diode (OLED), an anode of the lighting device is electrically connected to the second node and a cathode of the lighting device is electrically connected to a common ground voltage.

10. The display panel of claim 9, wherein the pixel circuit further comprises:

a third TFT, having a gate receiving a second control signal, a source receiving a test compensation signal and a drain electrically connected to the second node.

11. A display device, comprising a display panel having a pixel circuit, the pixel circuit comprising:

a first thin film transistor (TFT), having a gate electrically connected to a first node, a source receiving a working voltage and a drain electrically connected to a second node;

a second TFT, having a gate receiving a first control signal, a source receiving a data signal, a drain electrically connected to the first node;

a first capacitor, having a first end electrically connected to the first node and a second end electrically connected to the second node;

a second capacitor, having a first end electrically receiving a feedback compensation signal and a second end electrically connected the first node; and a lighting device;

wherein the feedback compensation signal and the first control signal have a same phase but different directions, and wherein a parasitic capacitance Cgs of the second TFT, a voltage value V1 of the first control signal, a voltage value V2 of the feedback compensation signal and a capacitance C2 of the second capacitor complies with an equation Cgs*V1=V2*C2.

12. The display device of claim 11, wherein the first control signal corresponds to a high voltage level and the feedback compensation signal corresponds to a low voltage level in a data writing phase, and the first control signal corresponds to a low voltage level and the feedback compensation signal corresponds to a high voltage level in a lighting phase.

13. The display device of claim 11, wherein a range of the voltage value V1 of the first control signal is from −6V to 24V.

14. The display device of claim 11, wherein the lighting device is an organic light emitting diode (OLED), an anode of the lighting device is electrically connected to the second node and a cathode of the lighting device is electrically connected to a common ground voltage.

15. The display device of claim 14, wherein the pixel circuit further comprises:

a third TFT, having a gate receiving a second control signal, a source receiving a test compensation signal and a drain electrically connected to the second node.

* * * * *